United States Patent [19]

Lieber

[11] Patent Number: 4,869,144

[45] Date of Patent: Sep. 26, 1989

[54] PICKUP ASSEMBLY FOR STRINGED MUSICAL INSTRUMENT

[75] Inventor: Thomas G. Lieber, Valley Stream, N.Y.

[73] Assignee: Thomas G. Lieber, Valley Stream, N.Y.

[21] Appl. No.: 300,602

[22] Filed: Jan. 23, 1989

Related U.S. Application Data

[63] Continuation of Ser. No. 051,413, May 19, 1987, abandoned.

[51] Int. Cl.[4] ..... G10H 3/18

[52] U.S. Cl. ..... 084/1.15; 336/110

[58] Field of Search ..... 84/1.14, 1.15, 1.16, 84/DIG. 21, DIG. 30; 338/182; 403/61, 80, 146; 74/531, 501 A, 484 R, 471 R; 336/110, 130, 132

[56] References Cited

U.S. PATENT DOCUMENTS

| | | | |
|---|---|---|---|
| 1,382,529 | 6/1921 | Morton | 74/484 R |
| 2,573,254 | 10/1951 | Fender | 84/1.15 |
| 2,612,541 | 9/1952 | De Armond | 336/110 X |
| 2,964,985 | 12/1960 | Webster | 84/1.15 |
| 4,135,426 | 1/1979 | Rickard | 84/1.16 |
| 4,160,401 | 7/1979 | Tomioka | 84/1.16 |
| 4,535,668 | 8/1985 | Schaller | 84/1.15 |

FOREIGN PATENT DOCUMENTS

| | | | |
|---|---|---|---|
| 2173032 | 10/1986 | United Kingdom | 84/1.16 |

*Primary Examiner*—Stanley J. Witkowski
*Assistant Examiner*—John G. Smith
*Attorney, Agent, or Firm*—J. M. Rosso

[57] ABSTRACT

Slotted bobbins consisting of a plurality of wire coils, are secured within a pickup for a stringed instrument assembly having an upper plate with a plurality of slots running in the direction of the strings, the slots of the bobbins being aligned with those of the upper plate. A magnetic pole piece is slidably disposed within each slot, each pole piece being independently slidable along the length of its slot, to allow reading each string at a different spectrum. The pole pieces are releasably secured within the slots so that they can be set at a desired point prior to playing of the instrument.

5 Claims, 1 Drawing Sheet

PICKUP ASSEMBLY FOR STRINGED MUSICAL INSTRUMENT

CROSS-REFERENCE TO RELATED APPLICATION

This application is a continuation of U.S. patent application Ser. No. 07/051,413, filed May 19, 1987, abandoned.

BACKGROUND OF THE INVENTION

This invention relates to a pickup assembly for electrical stringed instruments, and more particularly, to a pickup assembly having a plurality of slidable magnetic pole pieces disposed within corresponding slotted coils housed in the body of the instrument, the outer ends of the pole pieces functioning as contact points with the strings such that the magnetic pole pieces can be individually moved within the slots to read strings at different spectrums.

In playing of electrical stringed instruments it is highly advantageous that the player be able to adjust the point at which electrical contact is made with each string being played so as to achieve optimal tone reproduction. This is especially important in the playing of the electric guitar, as the player needs to be able to fine-tune the instrument so as to read the strings at different positions along their lengths. With most conventional pickup assemblies, however, the entire assembly is movably disposed within the body of the instrument, often with a bulky and clumsy sliding mechanisn for moving it up or down in the direction of the strings. Also, conventional pickup assemblies usually have wire leads which crimp and break after extended playing and movement of the assembly. Most importantly, the individual pole pieces of such assemblies remain stationary relative to each other as the entire assembly is moved, thereby limiting each pole piece to a reading of the same string length as its neighbors, and greatly restricting the tonal range of the instrument.

SUMMARY OF THE INVENTION

In accordance with this invention there is provided a pickup assembly having a plurality of slotted coils disposed in the body of the instrument with the slots running in the direction of the strings, and corresponding magnetic pole pieces slidably disposed within the slots of the coils such that each pole piece can be moved up or down the slot independently of the others, thereby allowing the player to read the strings at varying locations and permitting an improved tonal reproduction of sound. The magnetic pole pieces are releasably secured such that the player can make adjustments during the actual playing of the instrument, or with only mineral stoppage.

The pickup assembly is especially valuable for use with electric guitars used in popular or rock music, where fast and easy adjustment to provide varying tonal response is much sought-after. The assembly can also be used in a number of other electrical stringed instruments, such as electrical violins, violas, cellos, etc.

It is a primary object of this invention to provide a pickup assembly for stringed musical instruments having slidable magnetic poles which can be independently moved along slots of coiled bobbins disposed in the instrument body with the slots running in the same direction as the strings.

It is another objective of this invention to provide a pickup assembly which eliminates troublesome breakage of lead wires commonly occurring after continued playing of an instrument.

It is a further objective of this invention to allow the player a greater selection of positions at which each magnetic pole piece may be set during playing of the instrument.

DESCRIPTION OF THE PREFERRED EMBODIMENT

Figure 1:
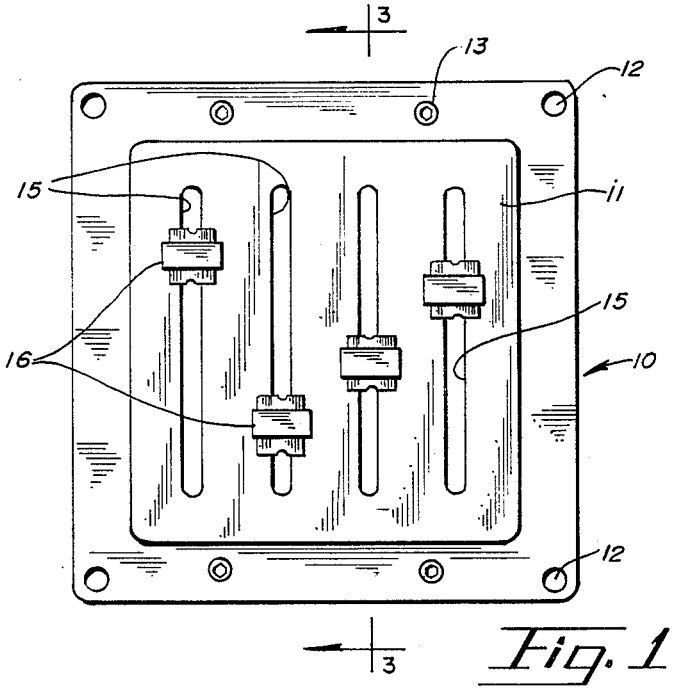
FIG. 1 is a plan view of the pickup assembly of this invention.
Figure 2:
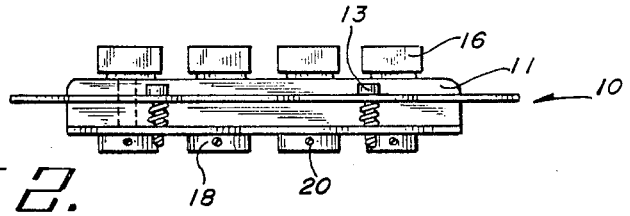
FIG. 2 is a side elevational view of the pickup assembly.
Figure 3:
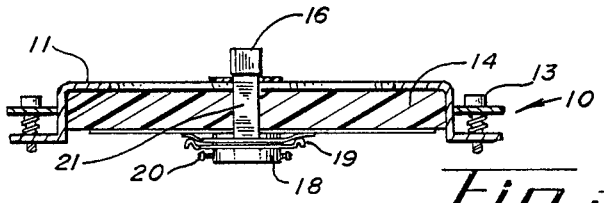
FIG. 3 is a cross-sectional view of the pick-up assembly taken along line 3—3 of FIG. 1 with a sliding pole piece in position.

Referring more specifically to the drawings, FIGS. 1 and 2 show a pickup assembly 10 with holes 12 for mounting of housing 11 on a guitar body, and threaded screws 13 for height adjustment of the assembly after mounting. A plurality of wire coils or bobbins 14, shown in FIG. 3, are secured within housing 11, each bobbin having a slot 15 running in the direction of the guitar strings. Four slotted bobbins 14, each having an identical magnetic pole piece 16 slidably disposed in its slot, are employed as shown in an electric bass guitar. A pickup assembly having fewer or more slotted bobbins with slidable pole pieces can be utilized, instead of only four bobbins as shown, whether on electric guitars or other electric stringed musical instruments, such as electric violins, violas, cellos, etc.

As shown in FIG. 3, each pole piece 16 with cross piece 18 can be manually slid within the slots 15, as shown in FIG. 1, along the strings over the entire length of the slots. Coiled bobbins 14 are wound with thin wire and have sots of from 2 to 6 inches along the entire length of which the pole pieces can be moved. It is the capability of the player to slide each pole piece independently of the others that allows the player to read strings from a variety of spectrums. Audio changes in tone occur as a result of the various placements of each pole piece in relation to the length of the strings. The further the pole piece is moved toward the front of the assembly, i.e., toward the peghead of the instrument, the more the tone produced will be of a bass tone. Conversely, if the pole piece is moved in the opposite direction, toward the bridge of the instrument, there will be produced more of a treble tone.

Figure 4:
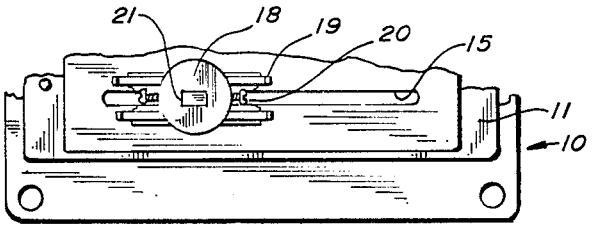
FIG. 4 is a fragmentary bottom view of the pickup assembly.

FIGS. 3 and 4 show a sliding pole piece 16 releasably secured within a slot 15 of a coiled bobbin 14 by means of sprung metal tensioner 19 and locking screw 20. The locking screw 20, with cross piece 18, is adjustable to increase or decrease its pressure against the shaft portion 21 of the pole piece 16 such that the player can easily change the position of a pole piece during play. The cross piece 18 is movably mounted on shaft 21 of the pole piece 16, as shown in FIG. 3, such that when locking screw 20 is loosened, it can be pushed toward the frame, increasing pressure of the tensioner 19. It is noted that positioning of the pole pieces during the actual play is limited to the string not in play at the time. Obviously, if the pole pieces are placed next to one another it will be more difficult to move them independently during play. If the pole pieces are spaced apart or staggered, they can be repositioned during actual playing of the instrument. Although pole pieces 16 having circular cross pieces 18 are shown, it is clear that a pole piece having any suitably shaped abutting means at one end could be used in the invention, such abutting means serving to prevent the piece from slipping through the slot of the coil in which it slides and also serving as a means to create the proper sliding tension. Thus, a rectangular head or cross-piece would suffice, in place of the circular cross piece 18 illustrated. The pole pieces 16 of this invention can be made of any suitable magnetic material, such as commonly used ceramic or metallic magnetic materials.

The sliding magnetic pole piece of this invention allows a greater selection of individual pole piece positioning than that presently existing in the art. It is especially valuable for use in electric guitars used for popular music. Additionally, the sliding pole piece mechanism eliminates wire breakage found with conventional assemblies because the wire leads of the coiled bobbins remain stationary along with the pickup assembly. The result is a pickup assembly providing greater tonal range to a stringed musical instrument, as well as increased reliability and longer wear of the instrument.

It is claimed:

1. A pickup assembly in an amplified stringed musical instrument naming a plurality of strings, comprising:

a housing having an upper plate with a plurality of elongated slots parallelly disposed therein, the slots running parallelly with and below the strings, there being one slot for each string; a plurality of elongated and slotted electrical coils disposed in the housing parallelly with the length of the strings, each slot thereof aligned with a respective slot of the upper plate of the housing;

a magnetic pole piece slidably disposed in each of the respective aligned slots for movement in a direction parallel to the length of the strings, the magnetic pole piece having an upper end adjacent to a musical instrument string and a lower end projecting through its respective slotted coil; and means disposed on the lower end of each magnetic pole piece for releasably securing each magnetic pole piece in its respective aligned slot such that each magnetic pole piece can be manually slid independently of the other magnetic pole pieces to thereby provide reading of each string at varying spectrums.

2. The pickup assembly of claim 1 wherein each magnetic pole piece comprises a magnetic rod extending through its respective aligned slot with its upper end adjacent to a musical instrument string, and a cross-piece member releasably secured to its lower end within the housing, and wherein the means for releasably securing each magnetic pole piece comprises a spring for biasing a respective magnetic rod against the housing such that manual pressure can move a respective magnetic pole piece within its respective aligned slot along the length of the strings to a preferred playing position, and yet such that the spring will hold the respective magnetic pole piece immobile during playing of the instrument.

3. The pickup assembly of claim 1 wherein the slotted electrical coils are bobbins wound with thin electrical wire.

4. The pickup assembly of claim 3 wherein the slots of the bobbins have a length of about 2 to 6 inches.

5. The pickup assembly of claim 1 wherein the means for releasably securing each magnetic pole piece in its respective aligned slot comprises a metallic cross-piece member slidably disposed along an axis of a respective magnetic pole piece at a lower end thereof, the cross-piece member having holes on either side for receiving locking screws; a tensioner spring disposed between the cross-piece member and the housing; and locking screws disposed within the holes of the cross-piece members such that the cross-piece member can be pressed along the axis of the respective magnetic pole piece to flex the tensioner spring, following which the locking screws can be screwed into contact with the respective magnetic pole piece to set the respective magnetic pole piece within its respective aligned slot at a desired pressure permitting manual sliding of the respective magnetic pole piece within its respecitve aligned slot.

* * * * *